US009469439B1

(12) United States Patent
Polsinelli

(10) Patent No.: US 9,469,439 B1
(45) Date of Patent: Oct. 18, 2016

(54) BEVERAGE BOTTLE HOLDER

(71) Applicant: Francesco Polsinelli, Newmarket (CA)

(72) Inventor: Francesco Polsinelli, Newmarket (CA)

( * ) Notice: Subject to any disclaimer, the term of this patent is extended or adjusted under 35 U.S.C. 154(b) by 0 days.

(21) Appl. No.: 14/570,315

(22) Filed: Dec. 15, 2014

(51) Int. Cl.
*B65D 23/10* (2006.01)
*B65D 25/28* (2006.01)
*A47G 23/02* (2006.01)

(52) U.S. Cl.
CPC ..... *B65D 25/2817* (2013.01); *A47G 23/0241* (2013.01)

(58) Field of Classification Search
CPC ..... B65D 25/2817; B65D 25/2811; B65D 25/2805; B65D 23/106; B65D 23/104; B65D 23/10; A47G 23/0241; A47G 23/02
USPC ..... 220/710.5, 737, 741, 742, 752, 756, 220/758, 759, 762, 768, 771; 215/396, 397, 215/395; 16/425, 422, 430
See application file for complete search history.

(56) References Cited

U.S. PATENT DOCUMENTS 1,464,789 A * 8/1923 Ward ..... A47G 23/0241 215/226
1,702,555 A * 2/1929 Watson ..... A47G 23/0241 215/395
1,707,883 A * 4/1929 Silva ..... B65D 7/02 215/12.1
2,075,217 A * 3/1937 Milburn ..... 215/393
2,463,651 A * 3/1949 Stevens ..... A47G 23/0241 215/395
3,021,026 A * 2/1962 Clare ..... A47G 23/0241 215/395
4,486,043 A * 12/1984 Rais ..... B65D 23/106 215/396
4,660,876 A * 4/1987 Weldin ..... B65D 23/106 215/396
4,982,869 A * 1/1991 Robbins, III ..... A47J 45/075 215/395
5,183,169 A * 2/1993 Grzych ..... B65D 23/106 215/395
6,979,031 B2 * 12/2005 Coppotelli ..... A47G 23/0258 16/425
7,988,213 B2 8/2011 Muhlfelder
8,316,509 B1 11/2012 Thomson et al.
8,382,053 B2 2/2013 Webb
2009/0014454 A1 * 1/2009 Nelson ..... B65D 23/106 220/758
2013/0186849 A1 * 7/2013 Iwashita ..... B65D 23/106 215/396

FOREIGN PATENT DOCUMENTS

GB 2461034 A * 12/2009 ..... A47G 23/0241

* cited by examiner

*Primary Examiner* — Robert J Hicks
*Assistant Examiner* — Kareen Thomas
(74) *Attorney, Agent, or Firm* — Crossley & Stevenson IP Law

(57) ABSTRACT

A beverage bottle holder including a base, a handle with a center support portion, a neck support arm, and a neck support member. There is an aperture disposed on an upper side of the neck support member sized and shaped to receive a top end of a beverage bottle therethrough. The base has a cylindrical outer wall sized and shaped to receive a bottom end of the beverage bottle. The handle has a front and rear side with a pair of identical vertical protrusions disposed on the rear side. The neck support arm has a forward and a rearward side with a pair of vertical walls disposed on the rearward side. There is a channel disposed between the vertical walls and the vertical protrusions removably engage the channel. The beverage bottle holder secures a beverage bottle therein to provide ease of pouring the beverage bottle.

2 Claims, 6 Drawing Sheets

BEVERAGE BOTTLE HOLDER

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Various types of beverage container holders are known in the prior art. However, what is needed is a beverage bottle holder that provides an easier way to pour a beverage bottle. Many people buy beverages in two liter bottles. Many people have a hard time handling and pouring the beverage bottle without using two hands due to the size of the bottle. The present device stabilizes the beverage bottle and secures it in place and allows the user to pour the beverage from the beverage container using a handle that is provided in the present device.

FIELD OF THE INVENTION

The present invention relates to beverage container holders, and more particularly, to a beverage bottle holder.

SUMMARY OF THE INVENTION

The general purpose of the present beverage bottle holder, described subsequently in greater detail, is to provide a beverage bottle holder which has many novel features that result in a beverage bottle holder which is not anticipated, rendered obvious, suggested, or even implied by prior art, either alone or in combination thereof.

To accomplish this, the present beverage bottle holder includes a base. The base has a bottom wall, a cylindrical outer wall continuously conjoining the bottom wall, and an open top end. The base has a size, and shape to receive and conform to the bottom end of the beverage bottle to maintain the beverage bottle in an upright position when not in use and secure the beverage bottle within the beverage bottle holder when the beverage bottle is being poured.

A handle is disposed on the base. The handle has a proximal end attached to the base, a distal end, and a center support portion therebetween. The center support portion is attached to an outer side of the proximal end in a position parallel to the base outer wall. The handle proximal end is attached perpendicularly to the outer wall of the base providing adequate support of for handle.

A neck support arm is securingly removably disposed on the center support portion. The neck support arm has a lower end and an upper end. A hollow neck support member is disposed on an outer edge of the upper end. The neck support member has a frustoconical outer surface. The outer surface has an upper side. An aperture is centrally disposed in the upper side of the neck support member outer surface 48. The neck support member and the aperture have a size, and shape to receive and support a top portion of the beverage bottle therein providing support to ensure that the beverage bottle does not slip out when pouring the beverage bottle.

The neck support arm has a lower portion and an upper portion. The lower portion has a forward side and a rearward side. The upper portion is directed at an angle toward the base, and is configured to centrally position the neck support member in vertical alignment with the base ensuring a secure fit on the top portion of the beverage bottle. There is a pair of spaced apart vertical walls disposed on the rearward side in a position parallel to each other and perpendicular to the forward side. A vertical channel is continuously disposed between the pair of parallel vertical walls.

There is a front side and a rear side of the center support portion of the handle. The rear side has a pair of spaced apart parallel vertical protrusions. The vertical protrusions removably engaging the vertical channel. The ability to remove the neck support arm from the handle provides easy access to remove and alternately insert each of the bottom end of the beverage bottle from the base and the top portion of the beverage bottle from the neck support member.

Thus has been broadly outlined the more important features of the present beverage bottle holder so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
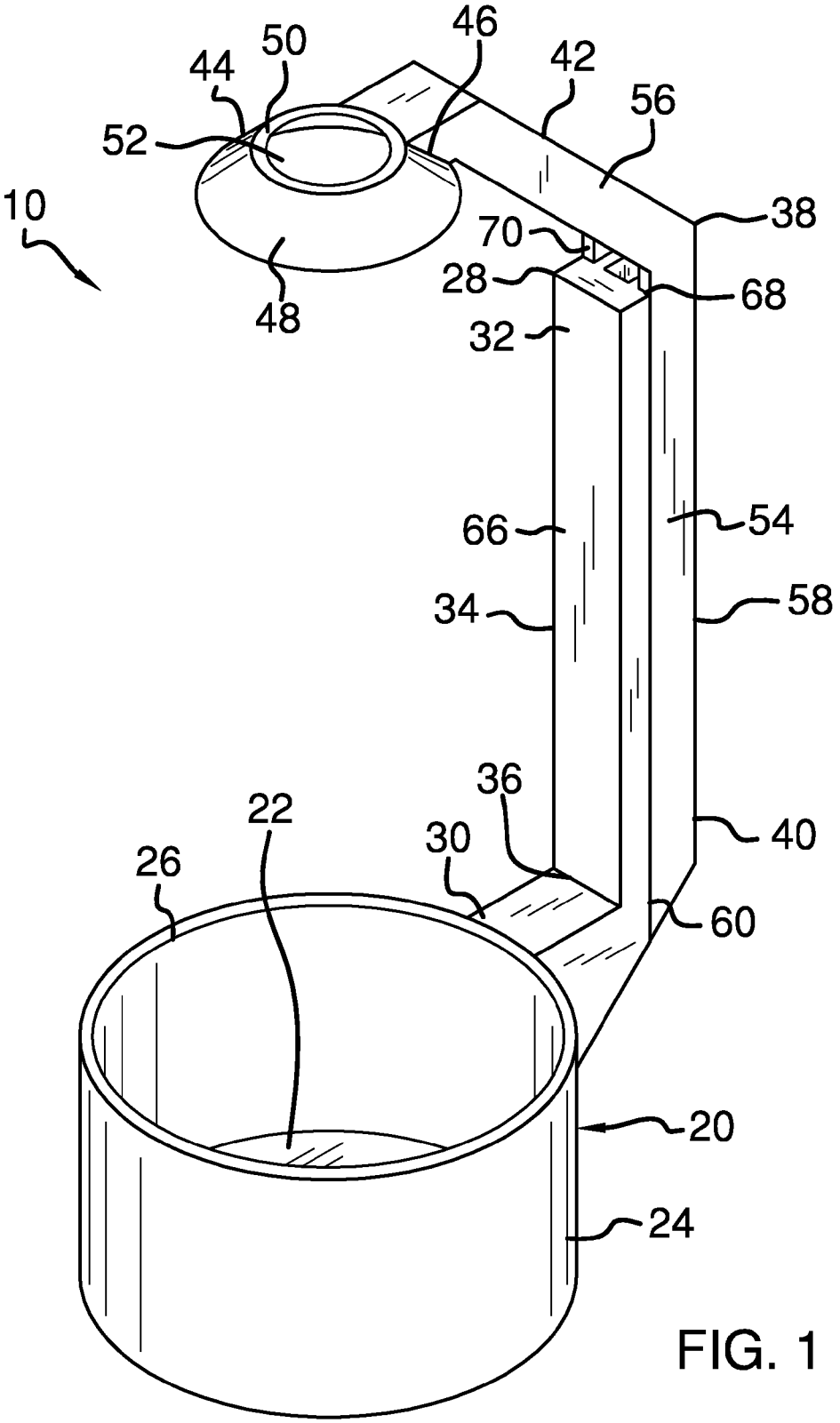
FIG. 1 is an isometric view.
Figure 2:
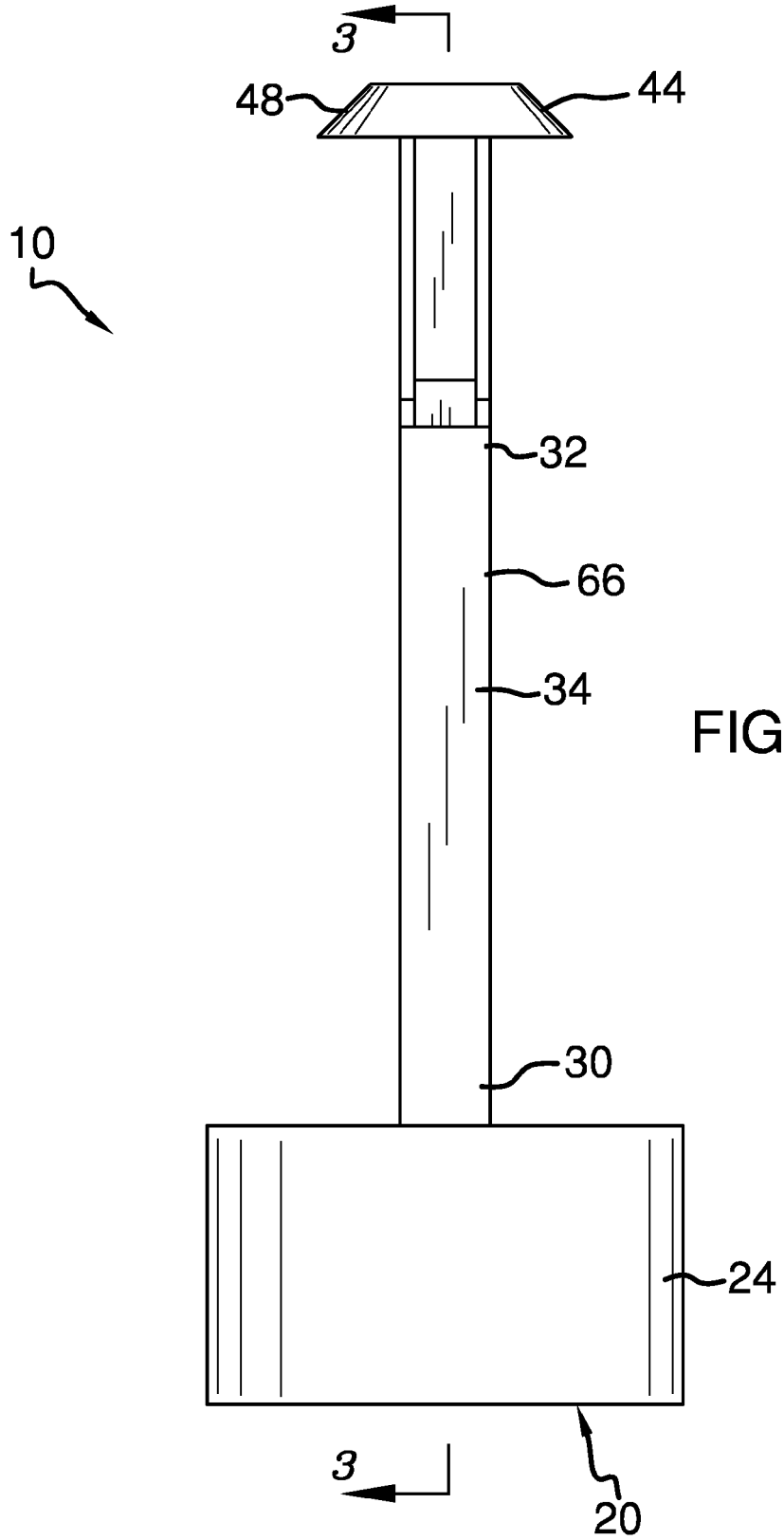
FIG. 2 is a front elevation view.
Figure 3:
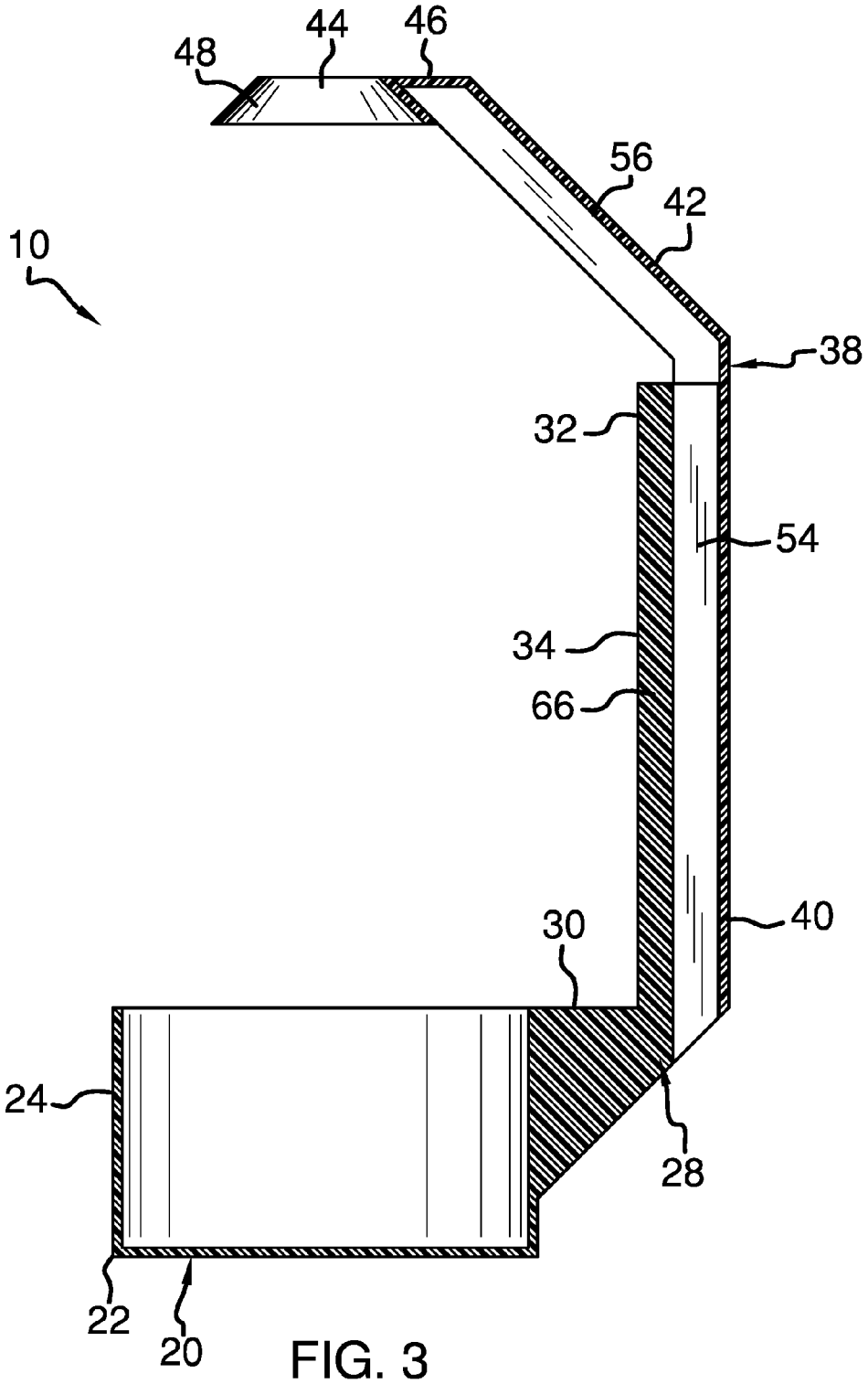
FIG. 3 is a cross-sectional view taken along line 3-3 of FIG. 2.
Figure 4:
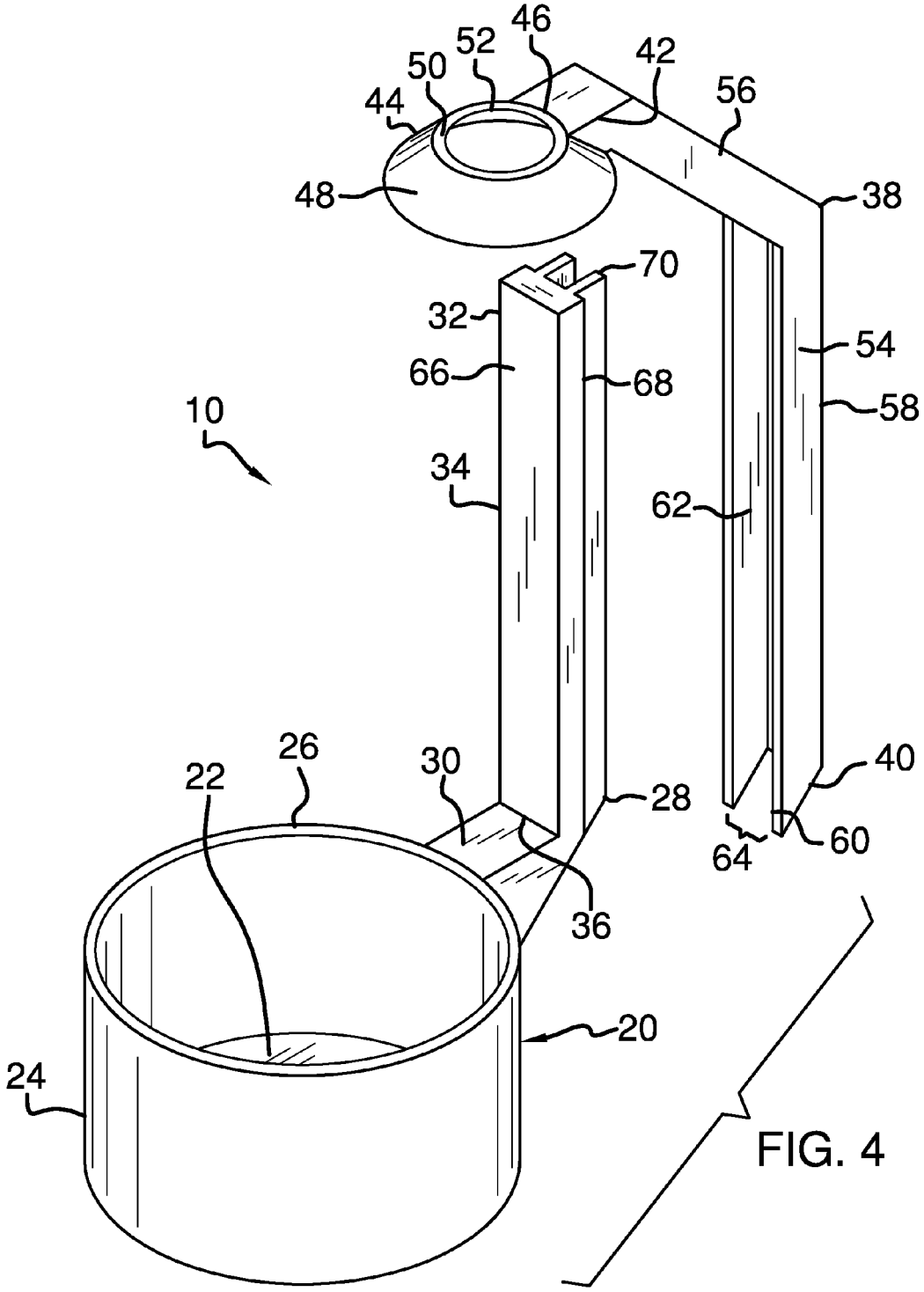
FIG. 4 is an exploded view.
Figure 5:
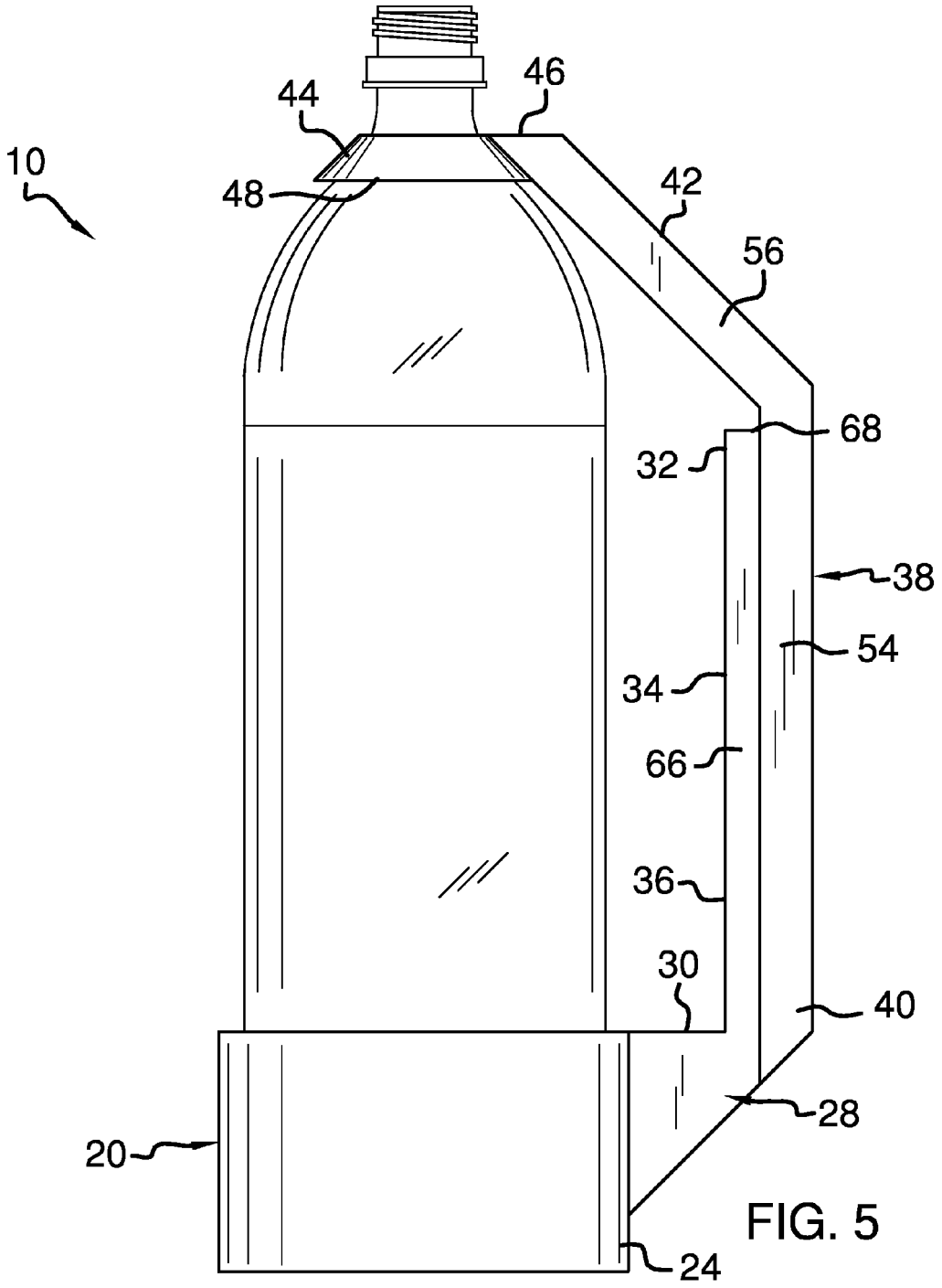
FIG. 5 is an in-use view showing the device holding a two liter bottle.
Figure 6:
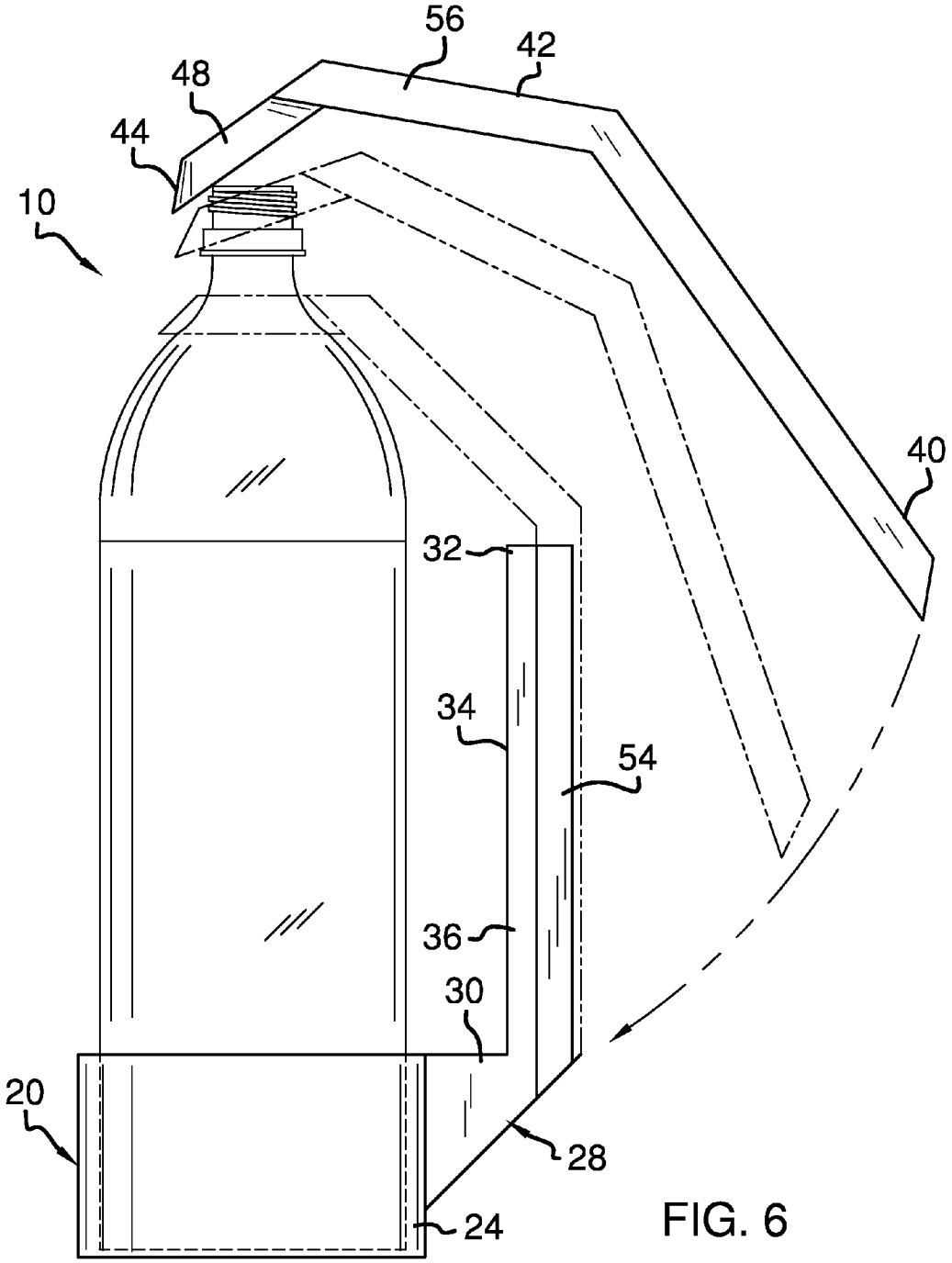
FIG. 6 is an in-use view illustrating the neck support arm removably engaging the handle.

With reference now to the drawings, and in particular FIGS. 1 through 6 thereof, an example of the instant beverage bottle holder employing the principles and concepts of the present beverage bottle holder and generally designated by the reference number 10 will be described.

Referring to FIGS. 1 through 6 the present beverage bottle holder 10 is illustrated. The beverage bottle holder 10 includes a base 20. The base 20 has a bottom wall 22, a cylindrical outer wall 24 continuously conjoining the bottom wall 22], and an open top end 26. The base 20 has a size, and shape to receive and conform to the bottom end of the beverage bottle to maintain the beverage bottle in an upright position when not in use and secure the beverage bottle within the beverage bottle holder when the beverage bottle is being poured.

A handle 28 is disposed on the base 20. The handle 28 has a proximal end 30 attached to the base 20, a distal end 32, and a center support portion 34 therebetween. The center support portion 34 is attached to an outer side 36 of the proximal end 30 in a position parallel to the base outer wall 24. The handle 28 proximal end 30 is attached perpendicularly to the outer wall 24 of the base 20 providing adequate support of for handle.

A neck support arm 38 is securingly removably disposed on the center support portion 34. The neck support arm 38 has a lower end 40 and an upper end 42. A hollow neck support member 44 is disposed on an outer edge 46 of the upper end 42. The neck support member 44 has a frustoconical outer surface 48. The outer surface 48 has an upper side 50. An aperture 52 is centrally disposed in the upper side 50 of the neck support member 44 outer surface 48. The neck support member 44 and the aperture 52 have a size, and shape to receive and support a top portion of the beverage bottle therein providing support to ensure that the beverage bottle does not slip out when pouring the beverage bottle.

The neck support arm 38 has a lower portion 54 and an upper portion 56. The lower portion 54 has a forward side 58 and a rearward side 60. The upper portion 56 is directed at an angle toward the base 20, and is configured to centrally position the neck support member 44 in vertical alignment with the base 20 ensuring a secure fit on the top portion of the beverage bottle. There is a pair of spaced apart vertical walls 62 disposed on the rearward side 60 in a position parallel to each other and perpendicular to the forward side 58. A vertical channel 64 is continuously disposed between the pair of parallel vertical walls 62.

There is a front side 66 and a rear side 68 of the center support portion 34 of the handle 28. The rear side 68 has a pair of spaced apart parallel vertical protrusions 70. The vertical protrusions 70 removably engaging the vertical channel 64. The ability to remove the neck support arm 38 from the handle 28 provides easy access to remove and alternately insert each of the bottom end of the beverage bottle from the base and the top portion of the beverage bottle from the neck support member.

What is claimed is:

1. A beverage bottle holder comprising:

a base having a bottom wall, an outer wall continuously conjoining the bottom wall, an open top end;

a handle disposed on the base, the handle having a proximal end attached to the base, a distal end, and a center support portion therebetween; and a neck support arm securingly removably disposed on the center support portion, the neck support arm having a lower end and an upper end;

a hollow neck support member disposed on an outer edge of the upper end, the neck support member having a frustoconical outer surface, the outer surface having an upper side;

an aperture centrally disposed in the upper side of the neck support member outer surface wall;

wherein the neck support member and the aperture are configured, sized, and shaped to receive and support a top portion of a beverage bottle therein;

wherein the base is configured, sized, and shaped to receive and conform to a bottom end of the beverage bottle to maintain the beverage bottle in an upright position;

a lower portion and an upper portion of the neck support arm, the lower portion having a forward side and a rearward side, wherein the upper portion is directed at an angle toward the base, wherein the upper portion is configured to centrally position the neck support member in vertical alignment with the base;

a pair of spaced apart vertical walls disposed on the rearward side in a position parallel to each other and perpendicular to the forward side;

a front side and a rear side of the center support portion of the handle, the rear side having a pair of spaced apart parallel vertical protrusions;

a vertical channel continuously disposed between the pair of parallel vertical walls, the vertical protrusions removably engaging the vertical channel;

wherein the handle proximal end is attached perpendicularly to the outer wall of the base; and wherein the center support portion is attached to an outer side of the proximal end in a position parallel to the base outer wall.

2. A beverage bottle holder comprising:

a base having a bottom wall, a cylindrical outer wall continuously conjoining the bottom wall, an open top end;

a handle disposed on the base, the handle having a proximal end attached to the base, a distal end, and a center support portion therebetween;

a neck support arm securingly removably disposed on the center support portion, the neck support arm having a lower end and an upper end;

a hollow neck support member disposed on an outer edge of the upper end, the neck support member having a frustoconical outer surface, the outer surface having an upper side;

an aperture centrally disposed in the upper side of the neck support member outer surface wall;

a lower portion and an upper portion of the neck support arm, the lower portion having a forward side and a rearward side, wherein the upper portion is directed at an angle toward the base, wherein the upper portion is configured to centrally position the neck support member in vertical alignment with the base;

a pair of spaced apart vertical walls disposed on the rearward side in a position parallel to each other and perpendicular to the forward side;

a front side and a rear side of the center support portion of the handle, the rear side having a pair of spaced apart parallel vertical protrusions;

a vertical channel continuously disposed between the pair of parallel vertical walls, the vertical protrusions removably engaging the vertical channel;

wherein the neck support member and the aperture are configured, sized, and shaped to receive and support a top portion of a beverage bottle therein;

wherein the base is configured, sized, and shaped to receive and conform to a bottom end of the beverage bottle to maintain the beverage bottle in an upright position;

wherein the handle proximal end is attached perpendicularly to the outer wall of the base; and wherein the center support portion is attached to an outer side of the proximal end in a position parallel to the base outer wall.

* * * * *